United States Patent [19]

Lieberman

[11] Patent Number: 4,895,336

[45] Date of Patent: Jan. 23, 1990

[54] IMPROVED POWER TOOL

[76] Inventor: Richard G. Lieberman, P.O. Box 245, Hanalei, Hi. 96714

[21] Appl. No.: 268,782

[22] Filed: Oct. 26, 1988

Related U.S. Application Data

[62] Division of Ser. No. 52,598, May 20, 1987, abandoned.

[51] Int. Cl.[4] ..... B25B 15/00

[52] U.S. Cl. ..... 248/690; 248/328; 248/339; 30/388

[58] Field of Search ..... 248/360, 317–325, 248/327–330.1, 359 R, 359 C, 359 G, 359 H, 359 I, 359 J, 610, 215; 242/107, 107.2; 30/296 R, 296 A, 388, 390; 408/235

[56] References Cited

U.S. PATENT DOCUMENTS

| | | | |
|---|---|---|---|
| B 562,601 | 3/1976 | Mack | 222/181 |
| 610,088 | 8/1898 | Scheerer . | |
| 658,716 | 9/1900 | Richardson et al. | 248/359 H |
| 805,145 | 11/1905 | Lewis | 248/359 I |
| 888,896 | 5/1908 | Howard | 248/359 C |
| 997,518 | 7/1911 | Taylor . | |
| 1,024,417 | 4/1912 | Pagnod . | |
| 1,433,616 | 10/1922 | Helden | 248/321 |
| 1,443,993 | 2/1923 | Koster . | |
| 2,352,406 | 4/1944 | Pond | 248/360 |
| 2,469,978 | 5/1949 | Mrozinski | 242/107 |
| 2,637,225 | 5/1953 | Benbow | 77/14 |
| 2,755,772 | 7/1956 | Palmer | 120/8 |
| 2,866,215 | 12/1958 | Scully | 248/359 C |
| 2,958,509 | 11/1960 | Mitchell | 254/168 |
| 3,112,911 | 12/1963 | Cornwell | 248/215 |
| 3,424,422 | 1/1969 | Klangos | 248/215 X |
| 3,433,431 | 3/1969 | Holcomb | 242/107 |
| 3,813,054 | 5/1974 | Klingspor | 242/86.5 R |
| 3,827,677 | 8/1974 | Meyerhoefer et al. | 259/104 |
| 3,881,751 | 5/1975 | Colby | 280/480 |
| 3,886,658 | 6/1975 | Wikoff | 30/388 |
| 4,033,532 | 7/1977 | Bergquist et al. | 248/17 |
| 4,114,736 | 9/1978 | Scherenberg | 191/12.4 |
| 4,151,648 | 5/1979 | Hirth | 32/22 |
| 4,219,177 | 8/1980 | O'Day | 248/215 |
| 4,305,553 | 12/1981 | Coquerel | 242/86 |
| 4,392,281 | 7/1983 | Metz et al. | 24/230.5 |
| 4,517,757 | 5/1985 | Asada et al. | 38/88 |

FOREIGN PATENT DOCUMENTS

| | | | |
|---|---|---|---|
| 409692 | 9/1979 | Fed. Rep. of Germany . | |
| 2455134 | 12/1980 | France | 248/215 |
| 1120389 | 12/1961 | Sweden . | |

OTHER PUBLICATIONS

*The Oregonian,* Advertisement on p. 4M W–MP3, Jan. 12, 1989.

*Primary Examiner*—Alvin C. Chin-Shue
*Attorney, Agent, or Firm*—Klarquist, Sparkman, Campbell, Leigh & Whinston

[57] ABSTRACT

A portable power tool includes a retractable hook assembly by which the tool can be safely suspended from the framing of a building under construction, out of harm's way yet within easy reach, when the tool is not in use. The retractable hook assembly desirably includes a cable and a spring-loaded cable retraction spool for coupling the hook to the tool. The hook is adapted to be maintained in an out-of-the-way position when the tool is in use so as not to interfere with the tool's normal operation. When it is desired to set the tool down, the hook is withdrawn from the assembly and engaged with a horizontal framing member. In one arrangement, the retracted hook is oriented so that it can engage a framing member directly, without first being manually withdrawn from the assembly. The retractable hook assembly can be retrofit onto existing power tools and provides safety and convenience measures not heretofore available.

5 Claims, 2 Drawing Sheets

IMPROVED POWER TOOL

This application is a division of Ser. No. 07/052598 filed May 20, 1987, now abandoned.

FIELD OF THE INVENTION

The present invention relates to portable power tools, and more particularly to an apparatus for securely suspending such tools from the framing of buildings under construction, out of harm's way yet within hand's reach, when such tools are not in use.

BACKGROUND AND SUMMARY OF THE INVENTION

Carpenters and other construction workers frequently use portable power tools in the construction of buildings. Such power tool work is preferably done on the ground where the workpiece can be set up on a sturdy support and the necessary tools placed safely on the ground when not in use. On occasion, however, particular tasks cannot be performed at ground level. Instead, they require that the carpenter work while perched in the framing of a building under construction. In most cases, this framing is two-by-four or two-by-six lumber oriented with its narrow side up. Carpenters working in such an environment must not only balance themselves on these narrow framing members, but must also provide space for their tools and other necessary supplies.

Many of a carpenter's necessary tools can be carried in a leather tool belt. Such belts are readily available to carry screwdrivers, hammers and even drills. Belts for holding drills generally include a holster-like assembly for containing the drill, rather than the smaller loops used to hold screwdrivers and hammers.

Other power tools are too large or too awkwardly shaped to be conveniently carried in a tool belt. Power saws and various pneumatically operated devices are examples. For expository convenience, the remainder of this discussion will focus on a portable power saw as an example of a cumbersome tool, although it is to be understood that the principles of the invention are not so limited.

Carpenters working in the framing of a building under construction have heretofore been forced to resort to unsatisfactory resting places for their large power tools when these tools are not in use. The simplest approach is simply to balance the tool on the framing of the building. However, the 1½ inch top surface of such framing provides little margin for error. If the framing member is knocked, or if the cord of the tool is moved, the tool can easily fall from its precarious position one or more stories to the ground, doing damage both to the tool and any item or human where it lands.

Somewhat more satisfactory than the simple balancing approach is for the worker to drive a nail into one of the nearby framing members. Most large power tools have some sort of hole or slot by which the tool can be hung. Many portable power saws, for example, have guide holes in their face plate which can be used for this purpose.

Although more secure than the simple balancing approach, the nail approach suffers in that the worker must put down the power tool so that he can drive the nail in place. Again, the worker has little option but to balance the tool on one of the framing members while driving the nail. Furthermore, each time the worker moves a few feet, a new nail must be driven (while the tool is again precariously balanced on the framing) if the tool is to be kept within the worker's easy reach.

A related approach to the foregoing nail technique is for the carpenter to construct a shelf in the framing. This can be as simple as a wide board laid between two framing members. Unfortunately, suitably wide boards are not usually available above ground in the framing of a building. Furthermore, setting up the shelf generally requires that the tool be set down temporarily. If the shelf is to be secure, it should be nailed in place, again necessitating that the worker lay down the tool in order to complete the nailing operation. Again, each time the worker moves, the shelf must be relocated if the tool is to be kept within easy reach.

A final approach to the problem is for the worker to simply lower the tool to the ground by the extension cord when the tool is not in use. However, this arrangement is inefficient as it requires a relatively lengthy operation to hoist and lower the tool before and after each use.

From the foregoing, it will be recognized that a need exists for a secure resting place for power tools used above ground level when such tools are not in use.

Accordingly, it is a primary object of the present invention to provide a secure resting place for power tools used above ground level when these tools are not in use.

Another object of the present invention is to provide a retractable hook mechanism for securely suspending a portable power saw out of harm's way, yet within easy reach, when the saw is not in use.

Still another object of the present invention is to provide a retractable hook mechanism for a portable power saw in which the hook is maintained in an unobtrusive position when the tool is in use.

Yet another object of the present invention is to provide a retractable hanging hook for a portable power saw in which the hook can be oriented, when in its retracted position, so that it can engage a framing member directly from its retracted position, without having to be manually moved.

The present invention can be summarized as the provision of an unobtrusive retractable hook assembly for a portable power tool which permits the tool to be conveniently and safely hung from any framing member. In the preferred embodiment, the hook, when in its retracted position, is oriented with respect to the tool so that the tool can be hung on a framing member without the worker needing to manipulate the hook.

These and other objects, features and advantages of the present invention will be readily apparent from the following detailed description of a preferred embodiment and several variations thereof, which description proceeds with reference to the accompanying drawings.

DETAILED DESCRIPTION

Figure 1:
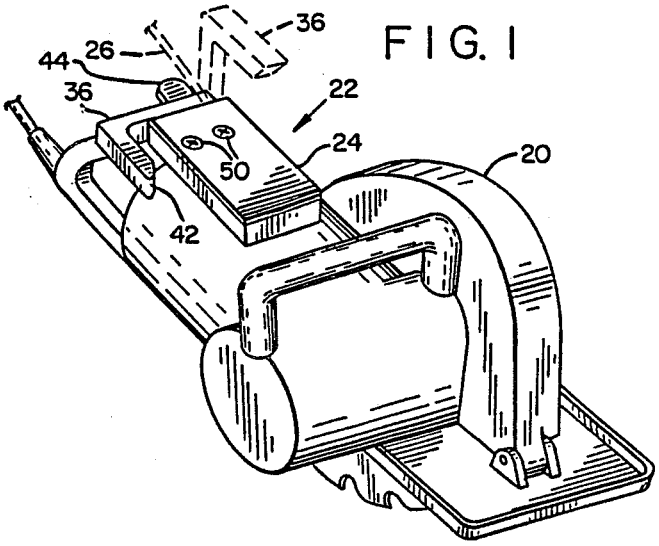
FIG. 1 is an isometric view of a portable power saw embodying a retractable hanging hook assembly according to the present invention.
Figure 2:
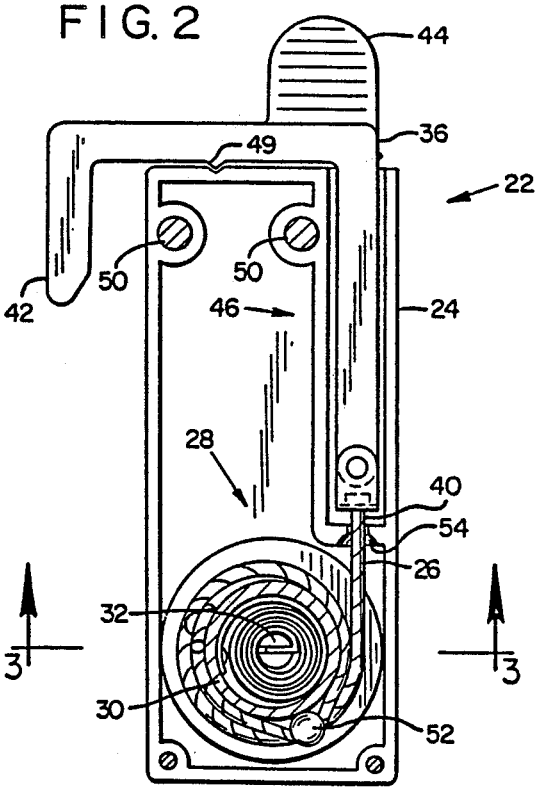
FIG. 2 is a top plan view showing the retractable hook assembly of FIG. 1 with its cover removed.
Figure 3:
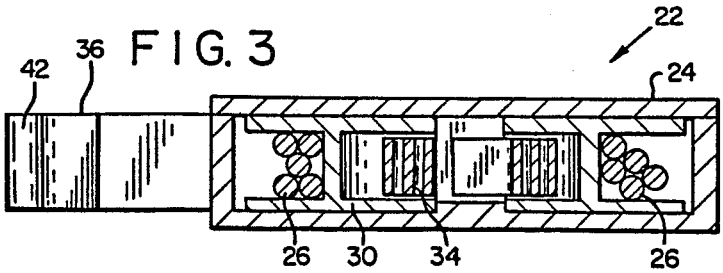
FIG. 3 is a sectional view taken along lines 3—3 of FIG. 2.

With reference to FIGS. 1–3, a portable power tool 20 is provided with an assembly 22 for hanging the tool from the framing of a building under construction when the tool is not in use. Assembly 22 includes an enclosure 24, a cable 26 and a spring-loaddd cable retraction spool 28. Spring-loaded cable retraction spool 28 is disposed within enclosure 24 and stores cable 26 in a spooled state. Cable 26 is desirably a high tensile strength stranded metal cable clad in plastic. Spring-loaded cable retraction spool 28 can comprise a rotatable spool 30 linked to a stationary central hub 32 by a concentrically wound spring 34.

Figure 4:
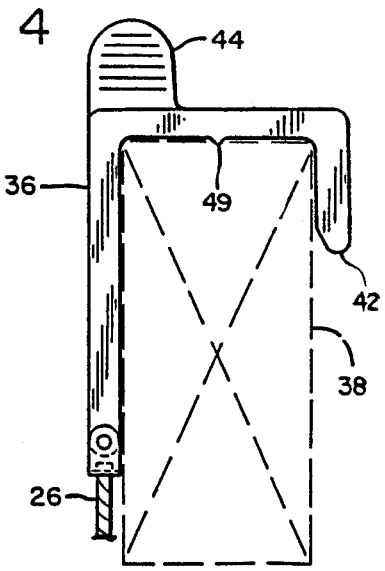
FIG. 4 is a view showing the engagement between a hook and a framing member.

A hook 36 sized and shaped to hang from a wooden framing member 38 (FIGS. 4, 5) is connected to a first end 40 of cable 26. The second end of cable 26 is secured to rotatable spool 30. Hook 36 is adapted to be fixed in a position in which it does not interfere with operation of the portable power saw when cable 26 is in its spooled state. In the illustrated embodiment, hook 36 is received within enclosure 24 when in this spooled position. In this position, hook 36 includes portions protruding from enclosure 26, such as distal end 42 and a grasping tab 44, so that a user can grasp and pull the hook from the enclosure.

Desirably, hook 36 is formed of quarter inch stock having a square cross-section. Enclosure 24 is desirably provided with a channel 46 (FIG. 2), also square in cross-section, sized to receive hook 36 so that the hook can be received within the channel when not in use. In such configuration, hook 36 can be oriented with respect to channel 46 so that it assumes a variety of orientations. For example, as shown in FIGS. 1–3, hook 36 can be oriented so that it is disposed substantially adjacent the body of tool 20. Alternatively, as shown in phantom lines in FIG. 1, hook 36 can be oriented so that it extends vertically above the tool. This second retracted hook position is desirable in that it allows a user to engage the hook directly to a framing member without manually moving the hook. That is, when it is desired to suspend the saw during an idle period, the user simply lowers the saw adjacent a framing member so that hook 36 engages the framing. The user need not remove his hands from the tool.

Figure 5:
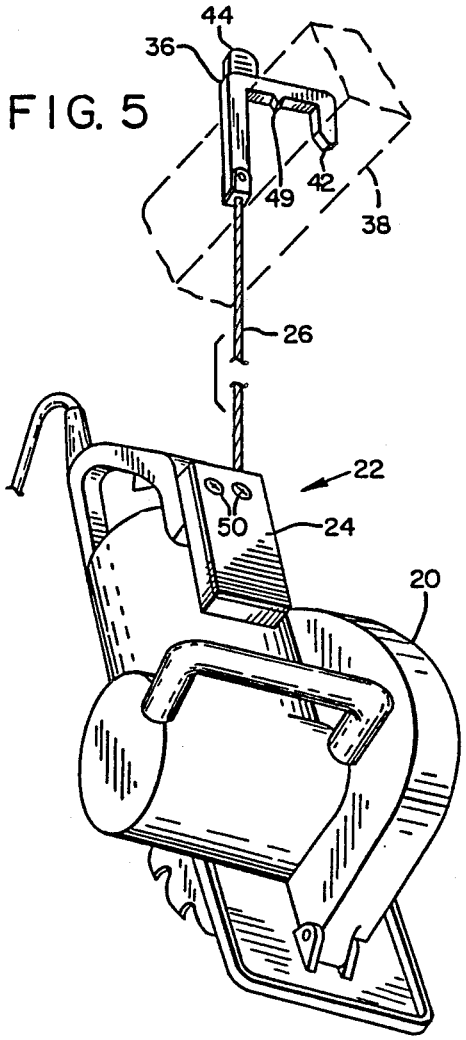
FIG. 5 is an isometric view showing the portable power saw of FIG. 1 suspended from a framing member.

When the tool is hung by hook 36 and cable 28, the distribution of the tool's weight about the retractable hook assembly causes the tool to hang at an incline with its grip angled upwardly, as shown in FIG. 5. In this position, the hanging tool can be conveniently grasped by the worker when it is desired to use the tool again.

In the preferred embodiment of the invention, hook 36 is desirably formed of metal, but alternatively can be formed of a high impact plastic or the like. Hook 36 also desirably includes a tooth member 49 or other frictional engagement means to prevent slipping of the hook when positioned on an inclined framing member.

Enclosure 24 is desirably affixed to portable power saw 20 by two bolts 50. Power saws typically include two bolts in the approximate location illustrated in the figures for securing the plastic saw handle to the body of the saw. These standard bolts can be removed and replaced with slightly longer bolts that additionally serve to affix enclosure 24 to saw 20. In this fashion, no modification need be made to the saw in order for the retractable hook assembly to be installed.

Retractable hook assembly 22 desirably includes a strain relief system for relieving from spring-loaded cable retraction spool 28 the weight of the saw when the saw is hung by the cable. A suitable strain relief system is shown n FIG. 2 and includes a small ball 52 securely attached to cable 26 near its second end and a stop gate 54 in fixed relationship to spool 28 and through which cable 26 passes. Stop gate 54 limits travel of cable 26 at the point at which stop ball 52 engages the stop gate. By this arrangement, the weight of the tool when suspended from the cable is borne by the engagement between stop ball 52 and stop gate 54, rather than by spring-loaded cable retraction spool 28.

Figure 6:
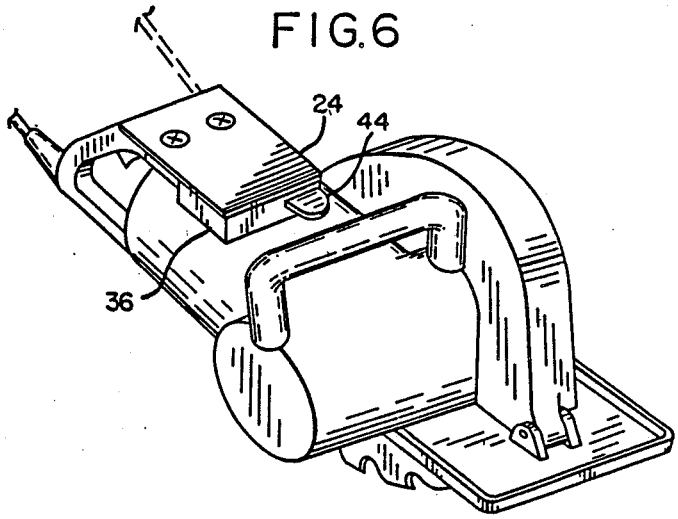
FIG. 6 is an isometric view of a portable power saw including an alternative embodiment of the present invention.
Figure 8:
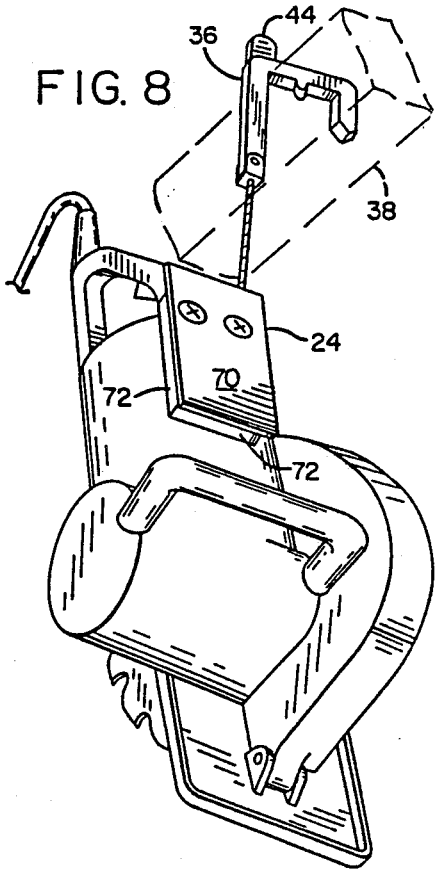
FIG. 8 is an isometric view showing the portable power saw of FIG. 6 suspended from a framing member.
Figure 7:
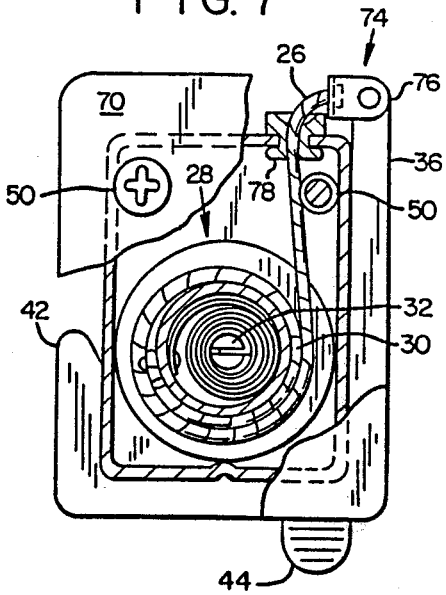
FIG. 7 is a top plan view, partially in section, of the retractable hook assembly shown in FIG. 6.

Referring now to FIGS. 6–8, an alternative embodiment of the present invention is disclosed wherein hook 36 and enclosure 24 are adapted so that the hook can be removably received about the outside of the enclosure. As shown in FIG. 8, enclosure 24 includes an upper surface 70 and side surfaces 72 recessed under top surface 70. By this arrangement, enclosure 24 can be sized to have outer dimensions no greater than the outer dimensions of hook 36. A compact retractable hanging hook assembly is thereby provided.

As shown in FIG. 7, cable 26 in this alternative embodiment is secured to hook 36 by a clevis arrangement 74 which allows cable 26 to extend at right angles from proximal end 76 of the hook. Also shown in FIG. 7 is a bearing 78 through which cable 26 extends to minimize frictional wear on the cable.

In this alternative embodiment, hook 36 must be manually removed from about enclosure 24 before it can be engaged with a framing member 38.

Figure 9:
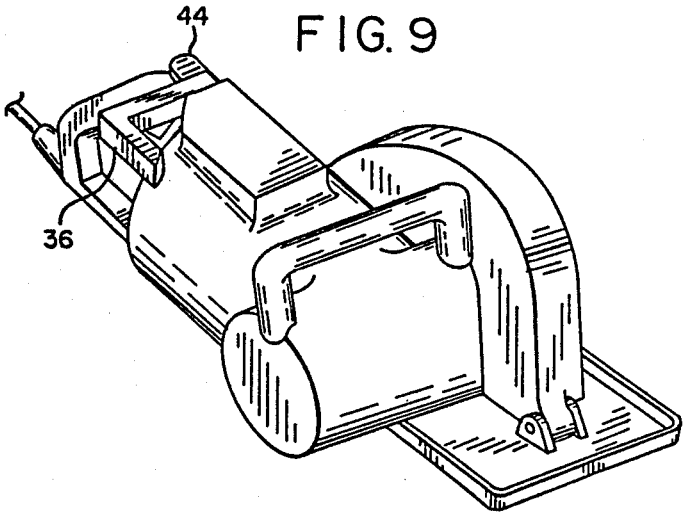
FIG. 9 is an isometric view of a portable power saw in which a retractable hook assembly is built into the handle of the saw.
Figure 10:
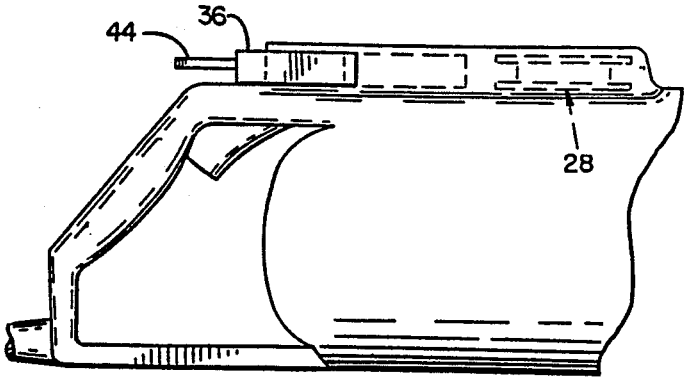
FIG. 10 is a partial side view of the portable power saw of FIG. 9.

In still another alternative embodiment of the present invention, shown in FIGS. 9 and 10, a retractable hook assembly can be integrally formed within the body of a portable power tool, such as within a power tool handle. The handle is desirably formed of a molded plastic and defines a hollow enclosure. Spring-loaded cable retraction spool 28 is disposed within this enclosure for storing cable in a spooled state. The cable again has one end securely coupled to the spring-loaded cable retraction spool and the other end securely coupled to a hook 36. Again, the retracted hook is adapted so as to not interfere with operation of the tool when the cable is in its spooled state. In the configuration illustrated in FIGS. 9 and 10, this position is substantially flat against the top of the saw body. However, as illustrated in FIG. 1, hook 36 can alternatively be oriented, when not in use, to extend vertically up from the saw body so as to more readily engage the framing of a building under construction.

Having described and illustrated the principles of my invention in a preferred embodiment and several variations thereof, it should be apparent to those skilled in the art that the invention can be modified in arrangement and detail without departing from such principles. For example, although the invention has been disclosed with reference to a spring-loaded cable retraction spool, the cable could alternatively be wound about a spool that is coupled by a centripetal-slip clutch arrangement to the spindle on which the saw blade of a power saw is mounted. When the saw is idle, the cable can be manually pulled from the spindle, causing the saw blade to turn in a backwards direction. When it is desired to retract the cord, the saw can be operated momentarily. The centripetal clutch arrangement causes the cable to be wound about the tool spindle until the hook is fully retracted, at which time the clutch disengages the spool from the spindle so that the spool does not continue to spin with the saw blade. If for some reason the cable is jammed and does not retract, the slip feature of the clutch disengages the spindle from the saw spindle automatically. Similarly, in other modified embodiments the positions of the saw and hook could be reversed, with the spring loaded spool assembly being affixed to the hook and the opposite end of the cable being fixedly secured to the saw. Of course, a variety of other equally diverse modifications to the illustrated structure can readily be devised. Accordingly, I claim as my invention all modifications coming within the scope and spirit of the following claims and equivalents thereof.

I claim:

1. An improved power tool comprising:

a power saw having first and second ends, the power saw also having a power saw body with an exterior surface positioned between the ends;

a hook adapted to hang from a wooden framing member, the hook having an elongated first leg with a longitudinal axis extending in a first direction and a hook forming portion at one end of the first leg, the hook forming portion having a hook end portion which together with the first leg defines a hook opening which is sized to hang from the framing member;

a hook attachment assembly having a housing detachably mounted to the exterior surface, the housing projecting outwardly from the exterior surface and from the power saw body, the housing having a socket for receiving the first leg of the hook, the hook attachment assembly having means engaging the hook to maintain the hook in a first position against pivoting movement relative to the housing with the first leg of the hook in the socket and the hook opening substantially closed by the tool body and permitting the shifting of the hook from the first position to a position in which the hook opening is open to receive the wooden framing member from which the tool is to be hung;

the hook attachment assembly being mounted to the body so as to prevent the hook from projecting beyond either of the first and second ends of the power saw when the hook is in the first position; and the hook end portion being exposed when the hook is in the first position.

2. An improved power tool according to claim 1 in which the hook comprises a square J-shaped hook with the hook opening being at least one and one-half inches.

3. The tool of claim 1 in which the hook end portion is exposed from all directions when the hook is in the first position.

4. The tool of claim 1 in which the housing has an attachment surface abutting the power saw body, the attachment surface not being recessed into the power saw body.

5. The power saw of claim 1 in which the hook attachment assembly includes a cable and a spring loaded cable retraction spool within the housing and in which the first leg of the hook is retractably coupled to the power saw by said cable and spring loaded retraction spool.

* * * * *